United States Patent [19]

Kenworthy

[11] 3,932,010

[45] Jan. 13, 1976

[54] FLUSH PULL ARRANGEMENT FOR OFFICE FURNITURE

[75] Inventor: Max H. Kenworthy, Montgomery, Ill.

[73] Assignee: All-Steel, Inc., Aurora, Ill.

[22] Filed: Jan. 23, 1975

[21] Appl. No.: 543,359

[52] U.S. Cl. ..... 312/320; 312/214

[51] Int. Cl.[2] ..... A47B 88/00

[58] Field of Search ..... 312/319, 320, 214, 330, 312/333

[56] References Cited

UNITED STATES PATENTS

| | | | |
|---|---|---|---|
| 3,098,686 | 7/1963 | Benoit | 312/320 |
| 3,300,887 | 1/1967 | Catiero | 312/320 |
| 3,338,649 | 8/1967 | Stewart | 312/320 |

*Primary Examiner*—Casmir A. Nunberg

*Attorney, Agent, or Firm*—Mann, Brown, McWilliams & Bradway

[57] ABSTRACT

A flush pull arrangement for office furniture and the like, and specifically, for use in connection with office furniture drawers and doors, in which the drawer or door front panel is formed with a quadrilateral opening to receive a quadrilateral open centered trim piece that is flanged about its forwardly facing side for fitting flush up against the front panel front surface, and that has opposed ridges coplanar therewith, on two opposed rails thereof, and along the rearwardly facing side of the trim piece, proportioned for snap fitting into the front panel opening. The front panel opening is formed on two opposed sides of same with a pair of opposed centering tabs that cooperate with correspondingly located notches formed in the rearward side of the trim piece, on the other pair of rails thereof, for centering the trim piece in the panel opening, and with which the trim piece has snap fit relation in applying the trim piece to the front panel opening. A cover having a pair of opposed edge portions each formed with a pair of spring tabs disposed one at either end of same, which cover edge portions are received in grooves formed in the trim piece between the flanges and ridges thereof, along the trim piece rails bearing the latter, and with the tabs thereof straddling the trim piece, to lock the trim piece in place and fix both the trim piece and cover against rattle. A hand tool for applying the cover to the trim piece is also disclosed.

8 Claims, 14 Drawing Figures

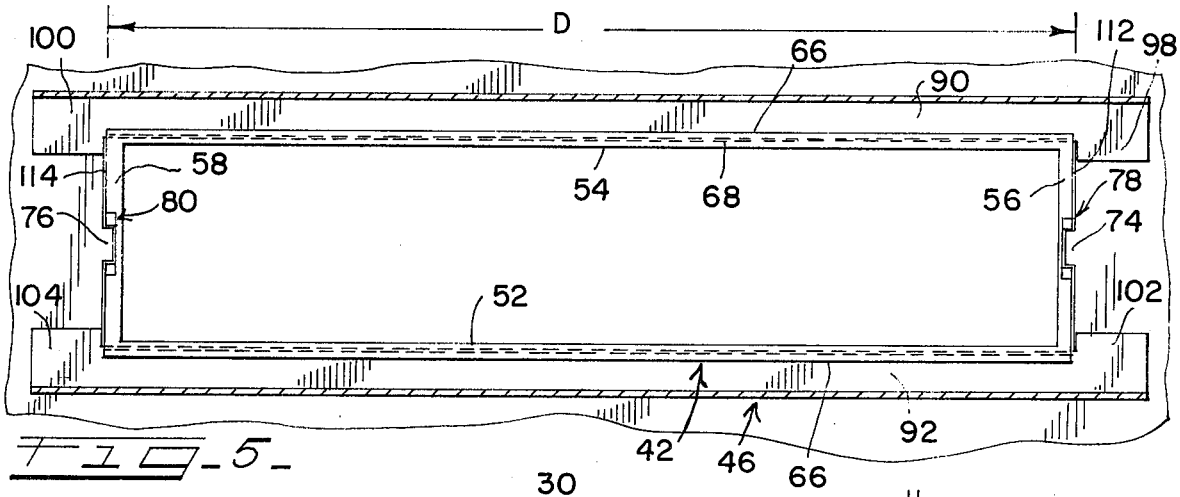
FIG. 5
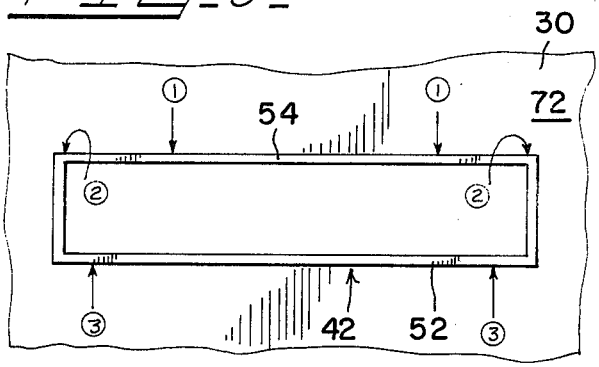
FIG. 6
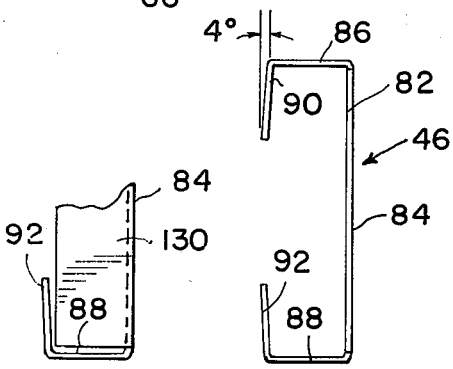
FIG. 4A FIG. 4
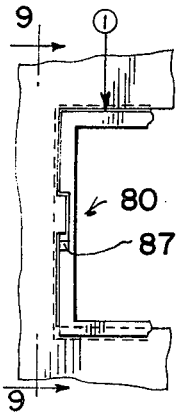
FIG. 7
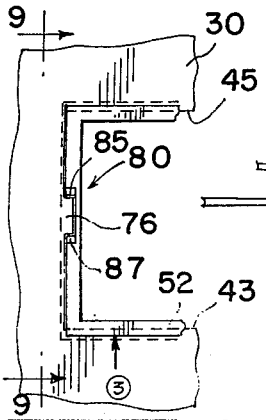
FIG. 8
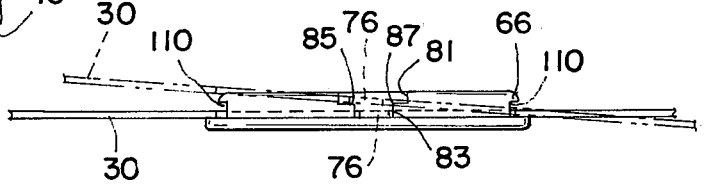
FIG. 9
FIG. 10
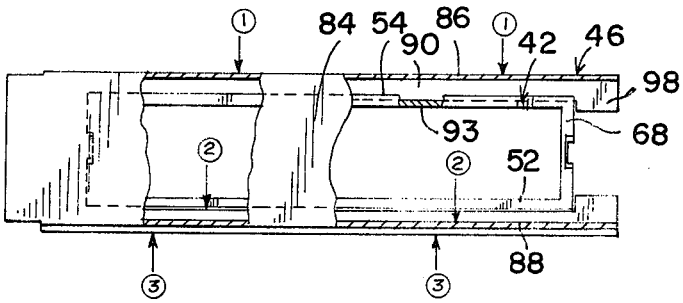

FLUSH PULL ARRANGEMENT FOR OFFICE FURNITURE

This invention relates to a flush pull arrangement for office furniture drawers and doors, and more particularly, to a pull arrangement that is essentially flush with the front side of the door or drawer front involved, and provides a hand gripping recess or pocket into which one may insert his fingers to move the door or drawer involved to open same.

Pull arrangements for office furniture file drawers and cabinet doors, and the like, conventionally have long been in the form of a handle suitably applied to the front surface of the drawer or door involved that is to be grasped by the user to move the drawer or door to open position. Pulls of this type necessarily project forwardly of the door or drawer involved, and form obstructions to passers-by that can and have caused injury, and that aesthetically are sometimes disfiguring.

More recently pull arrangements have come into use which involve the drawer or door front panel being in effect recessed to define a pocket into which the operator is to extend his fingers to grasp the drawer or door to pull same to the open position. Pull devices of this type frequently involve a trim piece or portion which overlies the marginal portions of the front panel involved that define the pull opening, a cover member that is applied to the inside of the front panel involved to close off the front panel pull opening and limit the pull pocket, and suitable securing screws or comparable fasteners that hold these parts together, or alternately, the trim piece and cover are suitably bonded in place, utilizing welding procedures or the like.

Of course, utilizing screws or the like to secure the pull components in place requires added parts and labor to complete the pull. Bonding of such parts in place, in addition to the labor involved, requires special treatment of the metal surfaces involved, after the pull has been applied to the front panel involved, so that distortions and other surface imperfections due to welding or the utilizing of other forms of bonding will be eliminated.

A principal object of the invention is to provide a flush pull arrangement for office furniture that requires no extra fasteners or bonding to secure the pull in place.

Another principal object of the invention is to provide a pull arrangement consisting of two principal components, in addition to the drawer or door front panel involved, that are formed for securement to each other in cooperation with the door or drawer front panel involved, such that the pull components are fixed to each other and to the front panel without using separate fasteners or bonding, in such a manner that all parts are made fast against rattle.

Other objects of the invention are to provide a pull arrangement that is aesthetically attractive in appearance, and that is applicable to all types of office furniture equipment utilizing pulls, including applications where lock devices are to be associated with the pull, and to provide a pull arrangement that is economical of manufacture, convenient to install, and long lived in use.

In accordance with the present invention, the pull arrangement comprises an open centered trim piece of rectangular shape that is to be applied to the drawer or door front panel involved, the latter being formed with a correspondingly shaped rectangular opening into which the trim piece is to be disposed. The trim piece is flanged about its forwardly facing side for abutting relation with the front panel involved, about the margin of its opening, and the trim piece along each of its two longer rails, and at its rearwardly facing side, is formed with a laterally projecting ridge, which ridges are coplanar with the trim piece, and are proportioned to make the trim piece, along its two longer rails, too larger to fit through the front panel opening. The two shorter rails of the trim piece are notched for two phase cooperation with correspondingly located centering tabs that are defined by the front panel, and the trim piece longer rails are each formed with a groove or slot between the flange and ridge of the respective longer rails, whereby when the trim piece is to be applied to the front panel opening, the trim piece has its rear side aligned with the opening in congruent relation therewith, except that one longitudinal edge of the front panel opening is seated in one of the trim piece longer rail slots to dispose the trim piece sufficiently off center of the front panel opening to permit the other trim piece longer rail ridge to be inserted through the front panel opening, whereby the front panel tabs will have snap fitting relation with the trim piece shorter rails at their said notches, and when the trim piece is snap fitted past the front panel tabs, such tabs center the trim piece within the front panel opening.

Associated with the trim piece, for closing off the pull opening and making the trim piece fast against rattle, is a cover member of elongate channel shaped configuration having along its respective side flanges an edge portion, which edge portions are disposed in opposed relation and each define at either end of same a spring tab, which tabs of each cover member edge portion are spaced apart to receive the trim piece between them. The respective cover member edge portions are received in the respective trim piece longer rail grooves or slots, to complete assembly of the device, with the cover member edge portions being separated as needed, as by employing suitable hand tooling or camming techniques, to apply the cover member edge portions to the respective trim member slots, and with the tabs of each cover member edge portions straddling the trim piece and bearing against the rear side of the front panel to bind the pull components together and against the front panel whereby all parts are held against rattle. The cover member edge portion tabs preclude lateral movement of the cover member relative to the trim piece in the plane of the front panel.

Other objects, uses, and advantages will be obvious or become apparent from a consideration of the following detailed description and the application drawings.

In the drawings:

FIG. 4 is an end view of the pull cover member that is shown in FIGS. 2 and 3;

FIG. 4A is a fragmental view similar to that of FIG. 4 but showing the pull cover modified for door application;

FIG. 5 is a sectional view taken substantially along line 5—5 of FIG. 2, better indicating the manner in which the pull cover is applied to the pull trim piece to hold the pull components together;

FIG. 6 is a diagrammatic plan view taken from the front side of the pull and illustrating the manner of applying the pull trim piece to the drawer or door front panel, in accordance with the present invention;

FIGS. 7 and 8 are fragmental plan views taken from the rear side of FIG. 6 and illustrating additional specifics of applying the pull front piece to the drawer or door front panel;

Figure 3:
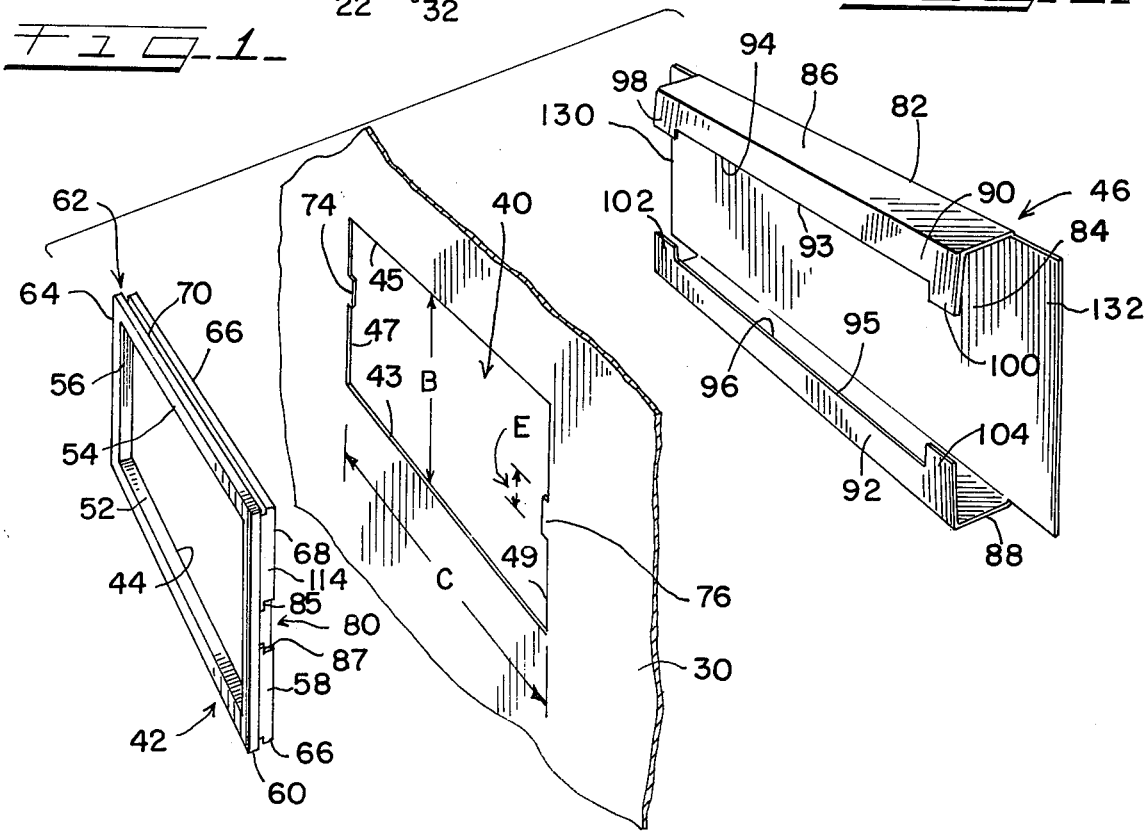
FIG. 3 is a diagrammatic exploded perspective view further illustrating the pull arrangement of the present invention.
Figure 11:
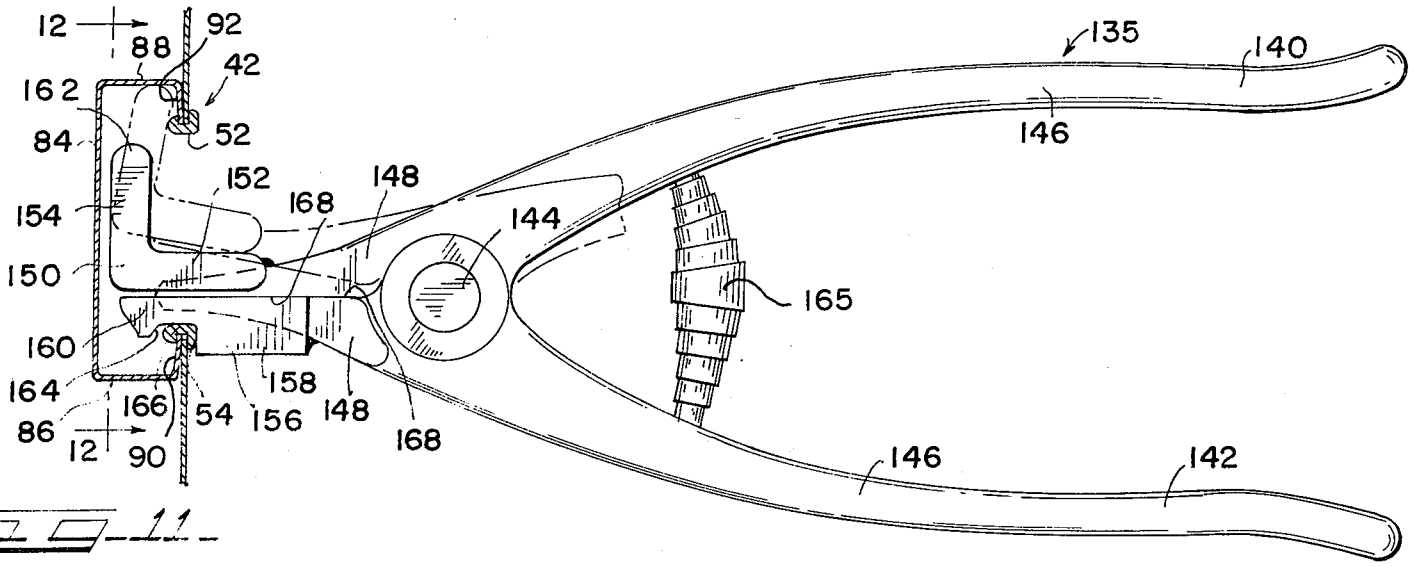
Figure 12:
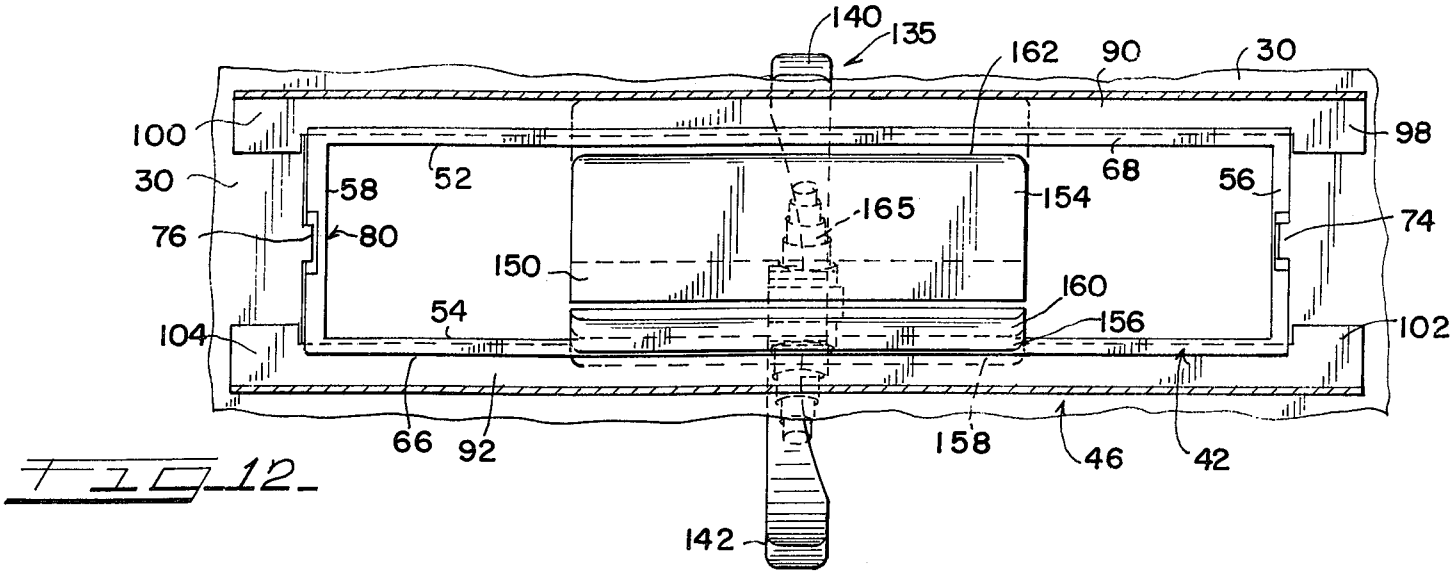
Figure 13:
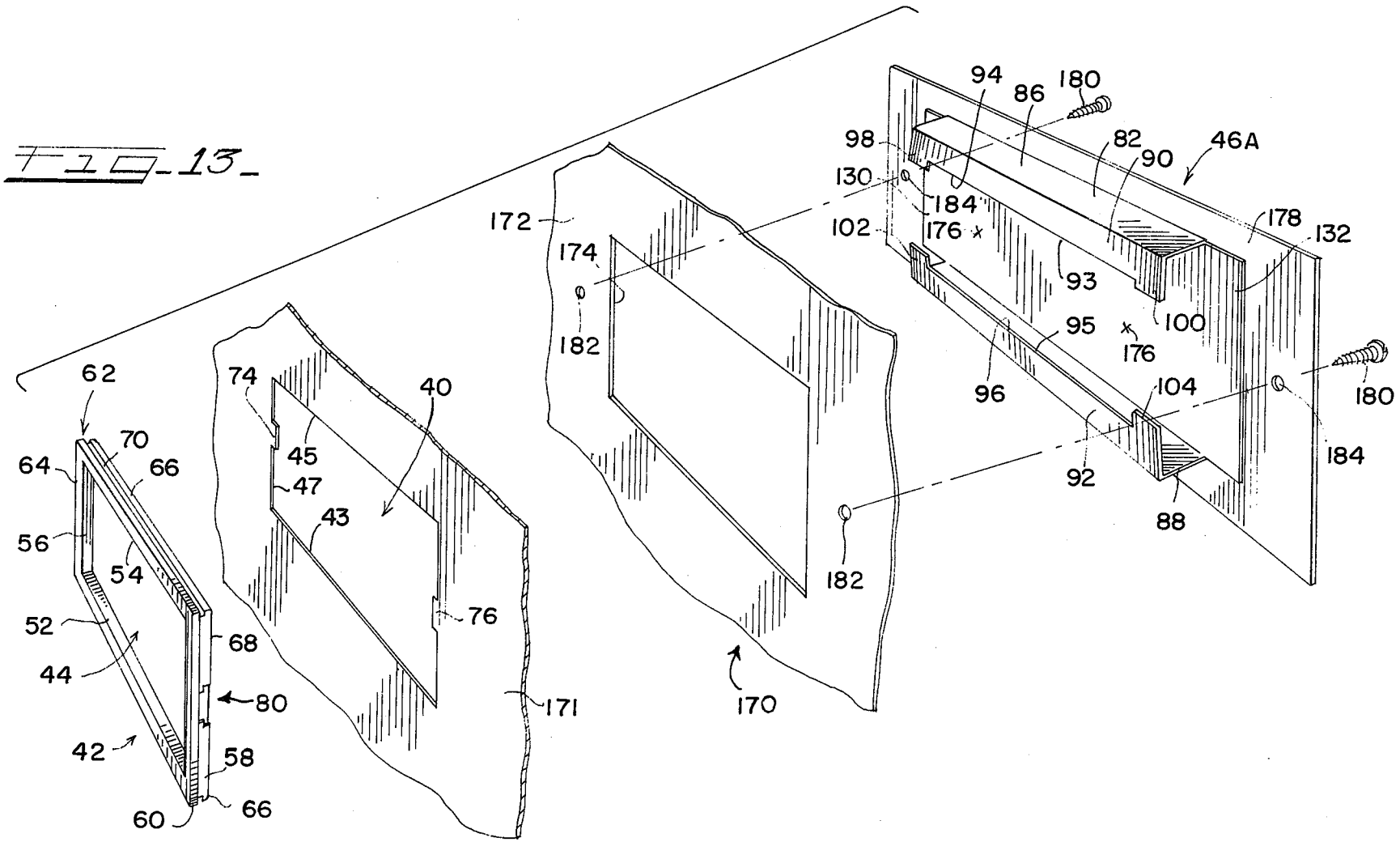

FIG. 9 is an edge view of one of the trim piece shorter rails better illustrating its notch and giving a two positioning of the front panel relative thereto as the trim piece is being applied to the front panel, with the showing being substantially along lines 9—9 of FIGS. 7 and 8 for illustrative purposes (with the plate member 30 being shown in dashed lines);

FIG. 10 is a plan view of the pull assembly as shown in FIG. 5, but partially in section and indicating the procedural steps taken to apply the pull cover to the pull trim piece to bind these parts and the drawer or door front panel in rattle-free mounted relation;

FIG. 11 is a plan view of a suitable hand tool that may be employed to apply the pull cover to the pull trim piece;

FIG. 12 is an end view of the tool of FIG. 11, taken along line 12—12 of FIG. 11; and FIG. 13 is a view similar to that of FIG. 3, but illustrating how the invention may be applied to desk drawers.

However, it is to be distinctly understood that the specific drawing illustrations provided are supplied primarily to comply with the requirements of the Patent Laws, and that the invention is susceptible of other embodiments that will be obvious to those skilled in the art, and which are intended to be covered by the appended claims.

Figure 1:
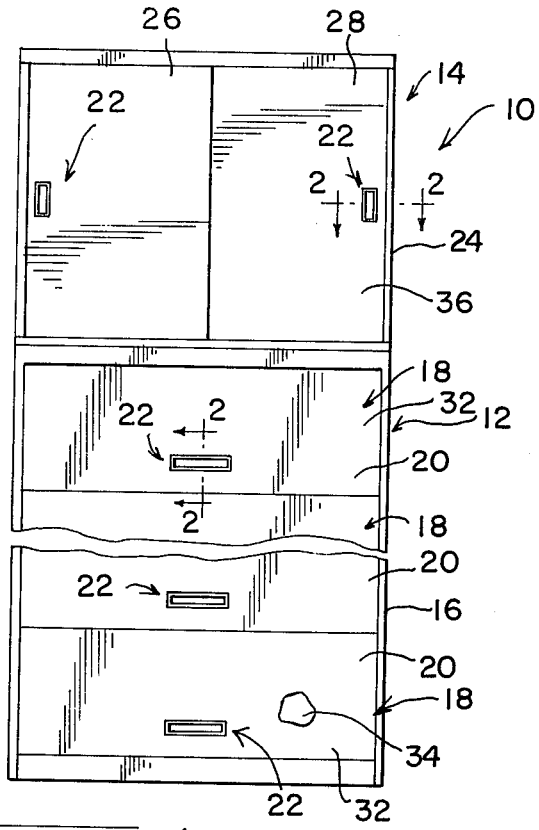
FIG. 1 is a front elevational view of a lateral file assembly on which is applied an over file assembly, both of which have the invention of this application applied thereto.

Reference numeral 10 of FIG. 1 generally indicates a filing arrangement comprising a file assembly 12 on top of which is applied an overfile assembly 14.

The file assembly 12 is of the lateral type and comprises a file cabinet 16 to which are applied a number of roll out drawers 18 each including a drawer front 20 having a pull arrangement 22 of this invention applied thereto.

The overfile 14 comprises cabinet 24 to which a pair of oppositely sliding doors 26 and 28 have been applied, each equipped with a pull 22 arrangement in accordance with this invention.

Aside from the arrangement of the pull 22, the lateral file 12 and the overfile 14 may be considered entirely conventional in arrangement. Of course, one or more of the pull out drawers 18 may be replaced by a roll out shelf of conventional design equipped with a swing up door, the front door of which may have the flush pull of this invention applied thereto, as well be apparent to those fully conversant with the office equipment field. The invention is also fully applicable to vertical file drawers and desk drawers as will be apparent to those familiar with the office furniture field.

Figure 2:
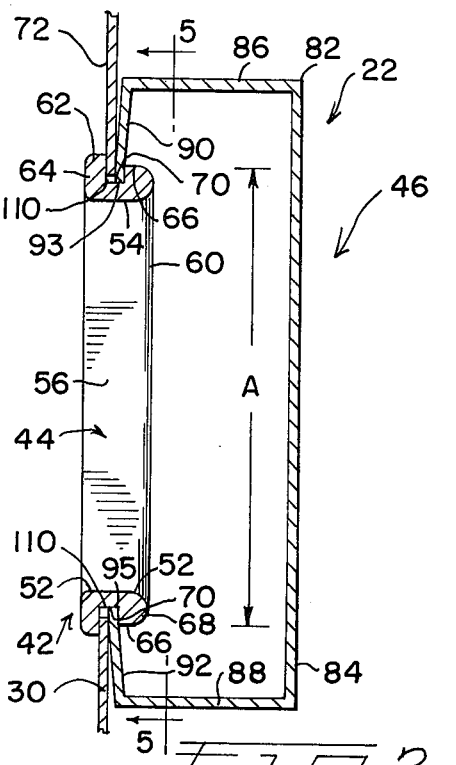
FIG. 2 is a fragmental cross-sectional view taken substantially along line 2—2 of FIG. 1, but on a substantially enlarged scale, showing the three components of the pull of this invention.

The general nature of the pull arrangement 22 is illustrated in FIGS. 2 and 3 wherein it will be seen that the pull arrangement comprises a plate member 30, which in practice will be the front panel of the drawer 20 or the doors 26 and 28 (or their equivalents in other pieces of office furniture). In this connection it is pointed out that the drawer fronts 20 conventionally comprise a front panel 32 and a rear panel 34 (see FIG. 1) suitably applied thereto. Cabinet doors, such as doors 26 and 28 usually comprise a front panel 36 which is free of any back or rear panel, as is well known to those skilled in these arts.

In any event, for purposes of this disclosure the plate member 30 may either comprise the front panel 32 of drawer fronts 20, the front panel 36 of cabinet doors 26 and 28, or the front panel of any piece of office equipment to which the pull is applicable.

The plate member 30, in addition to being formed for use as part of a drawer front or as a cabinet door (etc.), is formed to define pull opening 40 that receives pull trim piece 42 which defines the pull access opening 44, and which has applied to same the pull cover 46 that closes off the pull access opening 44 and, in accordance with the present invention, binds the pull components together, without using screws or other mechanical fasteners, or employing bonding procedures such as welding, whereby the pull components are held together against rattle.

Pull opening 40 defines lower and upper longer margins 43 and 45 and shorter side margins 47 and 49, which are rectilinear in configuration.

Further in accordance with the invention, the pull trim piece 42, which has lower and upper rails 52 and 54, and side rails 56 and 58, defining an open centered frame 60, is flanged as at 62 about its forward or front side 64, and along its longer rails 52 and 54 is formed with oppositely directed ridges 66 that are disposed at the rearward or back side 68 of the trim piece, with the ridges 66 being separated from the flanging 64 along the rails 52 and 54 by the respective slots 70.

The opening or aperture 40 of the plate member 30 is of the same general rectangular configuration as the trim piece 42 except that the front and rear sides 64 and 68 of the trim piece are of greater lateral dimensions along the longer length dimension of the pull access opening 44 and transversely of the trim piece. In accordance with this invention, the flanging 62, which extends lengthwise of all of the trim piece rails 52, 54, 56 and 58, is proportioned to abut the front side 72 of the plate member 30 about the margins of opening 40, while the ridges 66 are proportioned so that the pull has a dimension transversely of its longer rails 52 and 54 (dimension A of FIG. 2) which exceeds the corresponding dimension B of opening 40 such that the trim piece rear or back side 68 will not slip directly through the opening 40 of plate member 30 (see FIG. 2).

Opening 40, further in accordance with the invention, is formed to define a pair of opposed tabs 74 and 76 that are located in centered relation at the mid point of the narrow sides of the opening 40 for cooperation with the special stepped depth notches 78 and 80 that are formed in the trim piece respective side rails 56 and 58. Notches 78 and 80 each define a wide portion 81 and a narrow portion 83, with the notch portions 83 being proportioned to receive the respective tabs 74 and 76. Notches 78 and 80 each define opposing external corners or shoulders 85 and 87 (see FIG. 9). As will be made clear hereinafter, the tabs 74 and 76 and shoulders 85 and 87 of trim piece notches 78 and 80 are arranged for snap fitting relation in a manner that accommodates snap fitting of the trim piece 42 into the opening 40 and centering of the trim piece 42 with respect thereto.

The cover member 46 comprises a channel member 82 defining a web portion 84 and spaced side flanges 86 and 88 along either side of same and extending normally thereof. The respective angled edge portions 90 and 92 which are disposed in opposed relation, and are centrally notched or recessed, as indicated at 94 and 96 (see FIG. 3), respectively, whereby the edge portion 90 defines tabs 98 and 100 adjacent either end thereof and the edge portion 92 defines tabs 102 and 104 adjacent their respective ends of same and generally opposing the respective tab portions 98 and 100 of the edge portion 90.

As indicated in FIG. 4, the edge portions 90 and 92 of the channel member 82 are angled to their respective side flanges 86 and 88 so as to make obtuse angles therewith on the order of 94 degrees, whereby the cover member edge portions 90 and 92 spring bias the pull components in binding relation against rattle when these parts have been assembled as hereinafter described.

Before describing the special manner of assembly that is contemplated by the present invention for the pull arrangement 22, reference to FIGS. 2 and 3 will reveal several dimensional proportions that are important aspects of the invention.

Thus, the dimension B of the plate member opening 40 somewhat exceeds the corresponding distance between the bottom surfaces 110 of the respective grooves 70 so that the pull trim piece 42, when it has been snap fitted into place within pull opening 40 of plate member 30, has a certain amount of lost motion along the dimension B of the opening 40.

However, the dimensioning of the opening 40 along dimension C substantially complements or slightly exceeds the dimension D between the planar surfaces 112 and 114 of the trim piece side rails 56 and 58 that extend normally of the trim piece flanging 64 at either end of the trim piece.

The cover member edge portions 90 and 92 along the longitudinal margins 93 and 95 of their notches 94 and 96 are separated by a dimension that substantially equals the dimension between the trim piece groove bottom surfaces 110 for engagement therewith, as indicated in FIG. 2.

In addition, the thickness of the plate member 30 and the thickness of the cover member edge portions 90 and 92, relative to the width of the respective grooves 70, is made such that, when the cover member edge portions 90 and 92 are applied to the trim piece 42, after the latter has been mounted in pull opening 40, the edge portions 90 and 92 make a force friction fit within the grooves 70.

The web portion 84 of the channel member 82 in the form shown includes projecting end portions 130 and 132. When the pull arrangement is to be applied to a drawer or door that is not to have a rear panel, the end portions are angled 90 degrees forwardly of the web portion 84 to close off the sides of the pull, as indicated in FIG. 4A.

The pull components are assembled, in accordance with the present invention, and to apply them to drawers and doors of the type indicated in FIG. 1, in the following manner:

The trim piece 42 is aligned congruently with the pull opening 40, and the trim piece rear side 68, along one of the rails 52 or 54 of same, say the rail 52, inserted through the opening 40, the trim piece 42 is then disposed relative to the plate member 30 such that the bottom margin 43 of the pull opening 40 is seated in the groove or recess 70 of the bottom rail 52, to the full depth of such recess 70. This is indicated at step 1 of FIGS. 6 and 7, which results in the trim piece lower rail 52 having its ridge 66 protruding through the opening 40 of plate member 30, along the lower margin 43 of the opening 40, with the tabs 74 and 76 respectively bearing against the respective external shoulders 85 of the respective notches 78 and 80 (see FIGS. 7 and 9), and thus being disposed within the respective notch portions 81.

The forward side 64 of the trim piece is then pressed inwardly of the opening 40 (and rearwardly of the front surface 72 the plate member 30), along the upper portion of the trim piece in the area of its rail 54, with some bias being applied to the trim piece to slide it upwardly of opening 40, as indicated by the numbered steps 2 and 3 of FIGS. 6 and 8. This results in the ridge 66 of the upper rail 54 being pressed into opening 40 with the plate member flexing accordingly due to the bearing of its tabs 74 and 76 on corners 85, with the parts being proportioned so that as the trim piece top flanging nears engagement with thee front surface of plate member 30, the tabs 74 and 76 will snap past the shoulders 85 whereupon the tabs 74 and 76 are received in the respective notch portions 83 at either end of the trim piece 42 (see FIGS. 5, 8 and 9), which loosely centers the trim piece 42 within the opening 40. The proportioning of the tabs 74 and 76 along their dimensions relative to the notch portions 83 is such that margins 43 and 45 of opening 40 will be disposed in trim piece slots 70, whereby the trim piece will be held against movement in the plane of the member 30 that would permit unseating of trim piece rear side 68 from the opening 40.

It will thus be seen that the dimension A of the trim piece, relative to the dimension B of the opening 40 is such that while the trim piece rear or back side 68, along one longer rail of same will fit through the opening 40 when an upper or lower marginal edge 43 or 45 of the opening 40 is seated against the surface 110 of the trim piece rail groove 70 involved, but when the trim member 42 is centered within the opening 40, the trim piece rear or back side 68, by virtue of the ridges 66 and the movement limiting action of tab 74 and 76, is proportioned to preclude withdrawal of the trim piece from the opening 40. However, trim piece ridges 66 are proportioned so that when one longer rail of the trim piece 42 has a longer marginal edge (43 or 45) of opening 40 seated in its slot or groove 70, the ridge 66 of the trim piece other longer rail will clear the other longer edge of the opening 40 as the trim piece is pressed rearwardly of the plate member 30.

The channel member 82 is then applied to the rear side of plate member 30, as by bringing the cover member edge portions 90 and 92 into substantial registry with the rear or back side 68 of the trim piece, and inserting one of the edge portions 90 or 92, for instance the edge portion 90, in one of the trim piece slots 70 (for instance, that of rail 54); so that its marginal edge 93 seats against the slot bottom surface 110, with the edge portions tabs 98 and 100 disposed on either side of the trim piece 42, as indicated in FIG. 10 (where step No. 1 of the cover member application to the trim piece is shown applying the cover member flange portion 90 to the slot 70 of trim piece rail 54). This will leave the other edge portion (in this instance, the edge portion 92) disposed adjacent the trim piece rear or back side 68 along the trim piece bottom rail 52.

The edge portion 92 of channel member 82 is then suitably moved away from its opposing edge portion 90 sufficiently to have the edge portion marginal edge 95 clear the trim piece rear side 68 along the rail 52 and then released (see steps Nos. 2 and 3 of FIG. 10), whereby the edge portion 92 will lodge itself within the recess 70 of the trim piece bottom rail 52 and in engagement with the bottom surface 110 thereof, substantially as indicated in FIG. 2.

Step No. 2 of FIG. 10 may be effected by bringing edge portion 92 into flush engagement with the trim piece back side 68 and rapping the channel member web portion 84 with a suitable hammer, at the edge 92 side of same, with the trim piece front side disposed against a firm surface, whereby the curved configuration of the trim piece back side along rail 52 will cam edge portion 92 away from edge portion 90 to permit edge portion 92 to seat within the slot 70 of rail 52 with snap fit action (that is provided by the resiliently flexible material from which cover member 46 is made). Alternately, step No. 2 of FIG. 10 may be effected utilizing suitable tooling, such as hand tool 135 of FIGS. 11 and 12, operating through the trim piece from the front side of same to deflect the cover member side flange 88 sufficiently away from side flange 86, using the trim piece rail 54 as a purchase, to permit edge portion margin 95 to be moved forwardly of the pull into alignment with the slot 70 of trim piece rail 52, whereupon the tooling is released to permit the resiliency or "back spring" nature of the cover member to seat the cover member edge portion margin 95 firmly with the slot 70 of trim piece rail 52.

Of course, either cover member edge portion 90 or 92 may be initially applied to a trim piece slot in the manner indicated for edge portion 90, and the other edge portion deflected in the manner indicated for edge portion 92, to effect assembly of the pull components.

When this has been completed, the pull components are fully assembled, without having to employ screw fasteners or bonding or the like. The cover member edge portion tabs 98, 100, 102 and 104 are disposed on either side of the trim piece 42, and their obtuse angulation with respect to the cover member side flanges 86 and 88 introduces a wedging action into the assembly whereby the trim piece flanging 62 is pulled tightly against the front surface 72 of the plate member 30. The said cover member tabs also preclude lateral movement of the cover member relative to the trim piece, by engagement with the trim piece.

In one embodiment of the invention, the plate member 30 is 22 gauge sheet metal formed from a suitable steel while the channel member 82 is formed from similar materials and is of 24 gauge thickness. The trim piece 42 may be formed from any suitable metallic or plastic material, such as a suitable zinc alloy. As indicated, trim piece slots 70 are to be proportioned to receive both the plate member 30 and the cover member edge portion margins 93 and 95 with a friction fit. Thus, the width of the slots 70 should be substantially equal to the sum of the thickness of the plate member 30 at its opening margins 43 and 45, and the thickness of the respective cover member flange portions 90 and 92.

Hand tool 135 comprises a pair of levers 140 and 142 suitably pivoted together by pin 144 and each comprising a hand grip portion 146 and a tool head bearing portion 148. Tool bearing portion 148 of lever 140 has fixed to same a tool head 150 of right angled configuration including attachment flange 152 and working flange 154. Tool bearing portion 148 of lever 142 has fixed to same a tool head 156 having base portion 158 and notched portion 160. The tool heads 150 and 156 are elongate transversely of tool 135; head 150 has its flange 154 formed to define a rounded working edge 162 that is to engage a cover member side flange 86 or 88, and head 156 is formed to define a slot or notch 164 having a rectilinear base wall 166 which is to engage against a trim piece rail 52 or 54. Suitable spring 165 biases the tool portions 148 together along their planar abutment surfaces 168 to contact the tool so that it may be inserted through the pull trim piece 42. Surfaces 168 thus form stops that define the retracted position of tool 135.

Assuming that tool 135 is to be used to deflect cover side flange 88 away from side flange 86, as mentioned hereinbefore, the tool heads 150 and 156 are disposed within the pull, as shown in FIG. 11, with the trim piece rail 54 seated in slot 164 of head 156 and the tool heads roughly centered within the pull. Levers 140 and 142 are actuated to draw their portions 146 toward each other to bring edge 162 of tool head 150 against the cover side flange 88 with sufficient force to separate cover edge portion margin 95 from cover edge portion margin 93 as required to bring margin 95 into alignment with the slot 70 of trim piece rail 52, as by rocking the tool 135 somewhat, clockwise of FIG. 11, using the trim piece rail 54 as a center, whereupon the tool 135 is released; spring 165 brings the tool heads together for ready withdrawal of same from the pull.

FIG. 13 shows the invention in the form of embodiment 170 applied to a desk drawer of the type shown in Harris et al. U.S. Pat. No. 3,549,301, wherein the drawer front comprises a front panel 171 that is primarily for aesthetic purposes and a liner 172 that is the structural or load bearing member of the drawer front. In this arrangement, in which the pull 170 of FIG. 13 replaces the pull shown in said patent, the pull opening 40 is formed in panel 171, and the liner 172 has opening 174 formed therein through which cover 46A is passed for application to trim piece 42 in the same manner as already described. Cover 46A is the same as cover 46 except that it has fixed to its web portion 84, as by spot welding at 176, a connecting plate 178 that is connected to liner 172 by suitable screws 180 applied to the respective holes 182 and 184 formed in the liner and plate 178 for this purpose. This arrangement thus provides for secure connection of the cover member 46A to the drawer front liner 172. Opening 174 is of sufficient size to readily accommodate the assembly steps described hereinbefore.

It will therefore be seen that the invention provides a simple but effective pull arrangement that avoids the use of any mechanical fasteners or bonding procedures to secure the parts together. The invention contemplates the proportioning of the parts such that the trim piece by simple hand manipulation movements may be snap fitted and loosely centered within the plate member opening, after which the cover member is applied to the rear side of the plate member by having its opposed edge portions friction fitted into the same trim member grooves that receive the plate member marginal edges that define the pull opening, the trim components together are fixedly locked together. These components can be separated by reversing the assembly procedure, with a tool such as tool 135 being employed to deflect one of the cover member side flanges away from the other (as for instance, side flange 88 being acted on by hand tool 135) to unseat its edge portion margin from the trim piece slot 70 to which it has been applied and swing such side flange rearwardly of the trim piece, whereupon, when the tool is released, the cover member may be readily separated by hand from the trim piece. Separation of the trim piece from the plate member to which it is applied is effected by reversing the assembly procedure.

Where the cover member end portions 130 and 132 remain planar with the cover member web portion 84, separation of the cover member from the trim piece may be effected by slipping a flat rigid bar through the cover member (between it and the trim piece) and drawing it sidewise against one or the other of the cover side flanges to unseat one side flange from one of the trim piece slots 70. This avoids the need for a hand tool similar to tool 135.

Where the embodiment of FIG. 13 is involved, disassembly of the pull first requires removal of screws 180.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

I claim:

1. A pull arrangement comprising:

a plate member having a planar portion defining a front surface on one side of same and a rear surface on the other side of same, an aperture formed in said planar portion, an open centered planar trim piece seated in said aperture and having a front portion on the front side of said plate member and a rear portion on said trim piece defining a flange portion along each of two diametrically opposed segments of said trim piece projecting in the plane of said trim piece and outwardly of same that are in abutting relation with said plate member front surface and are at the front side of said trim piece, said trim piece further defining along each of said segments thereof a ridge projecting outwardly of said trim piece and in the plane thereof, with said ridges being on the rear side of said trim piece, said ridges and flange portions of the respective trim piece segments being separated therealong to define a slot along the respective trim piece segments, said ridges being proportioned in the plane of said trim piece for making the rear portion of said trim piece movable through said aperture from the front side of said plate member when one of the opposed marginal portions of said plate member defining said aperture is lodged in one of said slots with the rear side of the trim piece facing rearwardly of said plate member, means for centering said trim piece within said aperture, and a cover member on the other side of said plate member and defining opposed edge portions respectively frictionally received in said trim piece grooves, said cover member edge portions each defining a tab at either end of same and disposed to one side of said trim piece, with said tabs of each cover member edge portion being compressed against said plate member rear surface in straddling relation to said trim piece for holding said trim piece and cover to said plate member against rattle.

2. The pull arrangement set forth in claim 1 wherein said centering means comprises:

said plate member aperture being formed to define a pair of oppositely positioned tabs in opposed relation, said trim piece rear portion being formed to define a pair of oppositely positioned notches respectively receiving the respective plate member tabs, said trim piece notches being of like stepped depths defining a rearwardly disposed notch portion of greater dimension proportioned for lost motion relation to said plate member tabs to accommodate said movement of said trim piece rear portion into said aperture, and a forwardly disposed notch portion closely receiving the respective plate member tabs and being in snap fitting centered relation thereto.

3. The pull arrangement set forth in claim 1 wherein:

said cover member defines a back portion spaced rearwardly of said plate member rear surface and substantially paralleling said plate member planar portion, said cover member edge portions being angled forwardly of said trim piece, relative to the plane of said plate member planar portion, at an angle approximately four degrees.

4. A pull arrangement comprising:

a plate member having a planar portion defining a front surface on one side of same and a rear surface on the other side of same, an aperture of quadrilateral configuration formed in said planar portion, an open centered planar, quadrilateral trim piece seated in said aperture and having a front portion on the front side of said plate member and a rear portion on said trim piece defining a flange portion along each of two diametrically opposed lengths of said trim piece projecting oppositely in the plane of said trim piece and outwardly of same that are in abutting relation with said plate member front surface and are at the front side of said trim piece, said trim piece further defining along each of said lengths thereof a ridge projecting outwardly of said trim piece and in the plane thereof, with said ridges being on the rear side of said trim piece, and being oppositely disposed, said ridges and flange portions of the respective trim piece lengths being separated therealong to define a slot along the respective trim piece lengths, said ridges being proportioned in the plane of said trim piece to sufficiently exceed the corresponding dimension of said aperture for making the rear portion of said trim piece movable through said aperture from the front side of said plate member when one of the opposed marginal portions of said plate member defining said aperture is lodged in one of said slots with the rear side of the trim piece facing rearwardly of said plate member, means for centering said trim piece within said aperture, and a cover member on the other side of said plate member and defining opposed edge portions respectively frictionally received in said trim piece grooves against the rear surface of said plate member, said cover member edge portions each defining a tab at either end of same and disposed one at either end of said trim piece, with said tabs of each cover member edge portion being compressed against said plate member rear surface in straddling relation to said trim piece for holding said trim piece and cover to said plate member against rattle.

5. The pull arrangement set forth in claim 4 wherein said centering means comprises:

said plate member aperture being formed to define a pair of oppositely positioned tabs in opposed relation one at either end of said aperture, said trim piece rear portion being formed, at either end of said trim piece, to define a pair of oppositely positioned notches respectively receiving the respective plate member tabs, said trim piece notches being of like stepped depths defining a rearwardly disposed notch portion of greater dimension proportioned for lost motion relation to said plate member tabs to accommodate said movement of said trim piece rear portion into said aperture, and a forwardly disposed notch portion closely receiving the respective plate member tabs and being in snap fitting centering relation thereto.

6. The pull arrangement set forth in claim 4 wherein:

said cover member comprises an element of channel shaped transverse cross-sectional configuration with the ends of same disposed adjacent the aperture ends, said cover member having a flange portion across either end of same.

7. The pull arrangement set forth in claim 6 wherein:

said plate member comprises the front panel of a drawer, said cover member flange portions being disposed in parallelism with said cover member.

8. The pull arrangement set forth in claim 6 wherein:

said plate member is a door front panel, said cover member flange portions being disposed normally of said cover member to close the pull arrangement at either end of said aperture.

* * * * *